US007031012B1

(12) United States Patent
Serizawa

(10) Patent No.: US 7,031,012 B1
(45) Date of Patent: Apr. 18, 2006

(54) PRINTING APPARATUS AND ITS CONTROL METHOD, AND EXPENDABLE ATTACHED TO PRINTING APPARATUS AND HAVING MEMORY

(75) Inventor: Yoji Serizawa, Gotenba (JP)

(73) Assignee: Canon Kabushiki Kaisha, Tokyo (JP)

( * ) Notice: Subject to any disclaimer, the term of this patent is extended or adjusted under 35 U.S.C. 154(b) by 941 days.

(21) Appl. No.: 09/675,147

(22) Filed: Sep. 29, 2000

(30) Foreign Application Priority Data

Oct. 1, 1999 (JP) ..... 11-282142
Sep. 18, 2000 (JP) ..... 2000-282451

(51) Int. Cl.
*G06F 13/00* (2006.01)

(52) U.S. Cl. ..... 358/1.16; 399/49; 399/106; 399/262; 399/24; 399/25; 399/27; 347/214

(58) Field of Classification Search ..... 358/1.16; 399/49, 106, 262, 24, 25, 27; 347/214
See application file for complete search history.

(56) References Cited

U.S. PATENT DOCUMENTS 5,021,828 A 6/1991 Yamaguchi et al.
5,258,779 A 11/1993 Serizawa et al.
5,283,613 A 2/1994 Midgley, Sr.
5,365,312 A * 11/1994 Hillmann et al. ..... 399/12
5,550,573 A 8/1996 Serizawa et al.
5,564,036 A 10/1996 Sugai
5,708,912 A * 1/1998 Lee ..... 399/24
5,883,659 A 3/1999 Serizawa et al.
5,995,774 A * 11/1999 Applegate et al. ..... 399/27
6,347,853 B1 * 2/2002 Kato ..... 347/7
6,360,174 B1 * 3/2002 Shoki ..... 702/55
6,453,385 B1 * 9/2002 Sturges et al. ..... 711/129
6,658,219 B1 * 12/2003 Ito et al. ..... 399/27
2004/0233245 A1 * 11/2004 Matsumoto et al. ..... 347/19

FOREIGN PATENT DOCUMENTS

EP 0 338 089 10/1989
EP 0 877 304 11/1998
JP 10-39717 2/1998
WO 98/52762 11/1998

* cited by examiner

*Primary Examiner*—Edward Coles
*Assistant Examiner*—Alan Rahimi
(74) *Attorney, Agent, or Firm*—Fitzpatrick, Cella, Harper & Scinto

(57) ABSTRACT

This invention provides a printing apparatus which controls to inhibit any inadvertent write to a memory in an expendable so as to securely manage the exchange timing and the like of the expendable. For this purpose, the expendable such as a toner cartridge or the like comprises a rewritable nonvolatile memory (21) which holds information indicating whether or not its service life has expired. When the toner cartridge is attached to the printing apparatus, it is ready to communicate with a printer engine controller in the printing apparatus, and write to the nonvolatile memory (21) can be made in accordance with an instruction from a control unit. A lock functional unit (21*a*) writes information indicating write inhibition at a predetermined address in the nonvolatile memory (21), thus inhibiting write to the address position that stores the information indicating whether or not its service life has expired.

36 Claims, 15 Drawing Sheets

FIG. 4

| ADDRESS NO. | ADDRESS | CONTENTS |
|---|---|---|
| 1 | 000 | MANUFACTURING NO. (LOT NO.) OF CARTRIDGE |
| 2 | 001 | UNUSED |
| 3 | 010 | UNUSED |
| 4 | 011 | UNUSED |
| 5 | 100 | CARTRIDGE TONER REMAINING AMOUNT |
| 6 | 101 | CARTRIDGE SERVICE LIFE EXPIRE INFORMATION |
| 7 | 110 | LOCK SETUP FOR ADDRESS NOS. 1 TO 4 |
| 8 | 111 | LOCK SETUP FOR ADDRESS NOS. 5 TO 8 |

FIG. 8

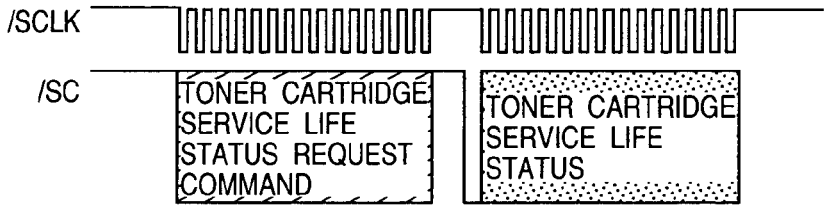

TONER CARTRIDGE SERVICE LIFE STATUS

| BIT | CONTENTS |
|---|---|
| 1st BIT | 0 |
| 2nd BIT | TONER CARTRIDGE SERVICE LIFE EXPIRE BIT |
| 3rd BIT | UNKNOWN |
| 4th BIT | UNKNOWN |
| 5th BIT | UNKNOWN |
| 6th BIT | UNKNOWN |
| 7th BIT | UNKNOWN |
| 8th BIT | PRINT COMMAND CODE 2^7 |
| 9th BIT | PRINT COMMAND CODE 2^6 |
| 10th BIT | PRINT COMMAND CODE 2^5 |
| 11th BIT | PRINT COMMAND CODE 2^4 |
| 12th BIT | PRINT COMMAND CODE 2^3 |
| 13th BIT | PRINT COMMAND CODE 2^2 |
| 14th BIT | PRINT COMMAND CODE 2^1 |
| 15th BIT | PRINT COMMAND CODE 2^0 |
| 16th BIT | ODD PARITY BIT |

FIG. 15

ALL ADDRESS AREAS OF MEMORY
(EACH 8BIT DATA)

| ADDRESS | CONTENT |
|---|---|
| 01h | NEW CARTRIDGE |
| 02h | INITIAL INSTALLATION DATE |
| 03h | TONER LOW |
| 04h | TONER OUT |
| 05h | RESERVED |
| 06h | RESERVED |
| ~ | ~ |
| FDh | PAGE COUNT (UNLOCKED AREA) |
| FEh | USED AMOUNT OF DRUM CARTRIDGE (UNLOCKED AREA) |
| FFh | LOCK BIT AREA |

THE CONTENT OF ADDRESS "FFh"

| BIT | CONTENT |
|---|---|
| 1st BIT | LOCK BIT OF ADDRESS "01h" |
| 2nd BIT | LOCK BIT OF ADDRESS "02h" |
| 3rd BIT | LOCK BIT OF ADDRESS "03h" |
| 4th BIT | LOCK BIT OF ADDRESS "04h" |
| 5th BIT | LOCK BIT OF ADDRESS "05h" |
| 6th BIT | LOCK BIT OF ADDRESS "06h" |
| 7th BIT | LOCK BIT OF ADDRESS "07h" |
| 8th BIT | LOCK BIT OF ADDRESS "08h" |

PRINTING APPARATUS AND ITS CONTROL METHOD, AND EXPENDABLE ATTACHED TO PRINTING APPARATUS AND HAVING MEMORY

FIELD OF THE INVENTION

The present invention relates to a printing apparatus and its control method, and an expendable attached to the printing apparatus and having a memory.

BACKGROUND OF THE INVENTION

FIG. 9 shows the arrangement of a conventional electrophotographic as an example of a printing apparatus of this type.

Referring to FIG. 9, reference numeral 1 denotes a photosensitive drum for forming an electrostatic latent image; 2, a charging roller for uniformly charging the photosensitive drum 1; 5, an optical unit for generating a laser beam which scans the surface of photosensitive drum 1 upon exposure; 6, a laser beam emitted by the optical unit 5; 3, a developer for developing an electrostatic latent image formed on the photosensitive drum 1, by toner; 4, a transfer roller charger for transferring a toner image on the photosensitive drum 1 onto a predetermined paper sheet; 7, a fixing device for melting and fixing toner on the paper sheet; 8, a standard cassette for storing a stack of paper sheets used in a print process; 9, a standard cassette feed roller for picking up a paper sheet from the standard cassette; 10, a manual insert tray; 11, a manual insert feed roller; 12, exhaust rollers for exhausting the paper sheet outside the apparatus; 13, a registration sensor for registering the leading end of a fed paper sheet in a print process; 14, an exhaust sensor for confirming if a paper sheet has normally been exhausted from the fixing device; 15, a sensor for detecting the presence/absence of paper sheets in the standard cassette; 16, a sensor for detecting the presence/absence of paper sheets to be manually inserted; 17, a toner cartridge (expendable) which integrates the photosensitive drum 1, charging roller 2, developer 3, and toner, and is detachable from the printer main body; 21, a nonvolatile memory mounted on the cartridge; 19, a connector for exchanging signals with the nonvolatile memory 21; and 20, a printer control unit for reading/writing data from/to the nonvolatile memory via the connector.

In the above arrangement, the nonvolatile memory 21 is mounted in the toner cartridge 17, and a printer engine writes data that pertains to the use state and the like of the cartridge in the memory so as to make control for managing on the basis of written data, e.g., the service life or the like of the photosensitive drum.

FIG. 10 is a block diagram showing the contents of the printer control unit 20 in FIG. 9 and its peripheries.

Referring to FIG. 10, reference numeral 101 denotes a printer controller for receiving image data via communications with a host computer, mapping the received image data to information that the printer can print, and exchanging signals with a printer engine controller (to be described below) via serial communications; and 102, an engine controller for exchanging signals with the printer controller via serial communications to control respective units of a printer engine. Reference numeral 103 denotes a paper feed controller for executing paper feed control when a paper sheet to be printed is fed and conveyed until the paper sheet is exhausted after the print process, on the basis of an instruction from the engine controller 102; 104, an optical system controller for executing drive control of a scanner motor and laser ON/OFF control on the basis of an instruction from the engine controller 102; 105, a high-voltage system controller for executing high-voltage output control required for electrophotographic processes such as charging, development, transfer, and the like on the basis of an instruction from the engine controller 102; 106, a fixing temperature controller for executing temperature control of the fixing device on the basis of an instruction from the engine controller 102, and detecting any abnormality or the like of the fixing device; 107, a paper sensor input unit for transferring information from the paper sensors in the paper feed unit and paper convey path to the engine controller; 108, a jam detector for detecting convey errors during paper convey; and 109, a failure detector for detecting any failure of a functional unit in the printer. Reference numeral 17 denotes the toner cartridge which is detachable from the printer engine, as described above. The toner cartridge 17 has a nonvolatile memory 21 which can exchange data with the engine controller 102, and allows the engine controller 102 to read out or write data. Further, the printer controller 20 corresponds to the engine controller 102 and the other controllers 103 to 109.

The engine controller 102 reads out or rewrites the memory contents of the nonvolatile memory 21 on the basis of the command of the printer controller 101 or each detecting unit. Note that the rewritable nonvolatile memory uses an EEPROM, but other devices, for example, a flash memory and the like, may be used.

FIG. 11 shows signals exchanged between the printer control unit 20 and nonvolatile memory 21. The printer control unit 20 includes a CPU, which is connected to the nonvolatile memory 21 in the toner cartridge 17 by serial communication lines via a drawer connector.

The serial communication lines are formed of TDATA serving as command data to be output from the printer control unit 20 to the nonvolatile memory 21, RDATA serving as return status from the nonvolatile memory 21, and SCLK serving as a sync clock.

TDATA is issued when the printer control unit 20 reads out the contents of the nonvolatile memory and rewrites its contents, and a read/rewrite instruction is set using command bits. The read address and rewrite data are output serially. In response to a read command, the nonvolatile memory 21 returns its address and data (or may return data alone). In case of a rewrite command, the address and write data are transferred.

The nonvolatile memory 21 has only a read/write function. For example, it is conceivable that when the printer control unit 20 writes data such as the service life of the toner cartridge 17 or the like, which is important in terms of control, even if that data is inadvertently rewritten due to the influence of some operation errors, it is required to be able to recover the important data. For this purpose, areas where important data is to be written are assigned to a plurality of addresses, and even when the contents of a given area are rewritten, data can be controlled to be recovered or prevented from being lost by reading information at another address.

However, the method of storing important data upon controlling the printer engine, e.g., data that pertains to the service life of the cartridge, at a plurality of address positions, the nonvolatile memory requires a large capacity and will result in an increase in cost of the system. Furthermore, for obtaining a reliable data, data of plurality of address positions must be read out for finding errors, and if an error occurs, the data of a subject read corrected by using the plural data is restored.

SUMMARY OF THE INVENTION

The present invention has been made in consideration of the above problems, and has as its object to provide a printing apparatus and its control method, which control to inhibit any inadvertent write to a memory in an expendable so as to securely manage the exchange timing and the like of the expendable, and an expendable attached to the printing apparatus and having a memory.

In order to solve the aforementioned problems, for example, a printing apparatus according the present invention comprises the following arrangement. That is, a printing apparatus to which an expendable having a memory for storing and holding information that pertains to a use state, and a recording agent used in a print process is detachably attached, comprises: memory access means for reading and writing to the memory in the expendable; and setting means for setting inhibition/permission of data write with respect to an address space in the memory.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 4 shows the internal format of a memory in the toner cartridge in the first embodiment;

FIG. 8 is a view showing the contents of status data from the toner cartridge and their transfer timing in the third embodiment;

FIG. 15 illustrates a memory map of the non-volatile memory according to the fourth embodiment.

DETAILED DESCRIPTION OF THE PREFERRED EMBODIMENTS

The preferred embodiments of the present invention will be described in detail hereinafter with reference to the accompanying drawings.

First Embodiment

Figure 1:
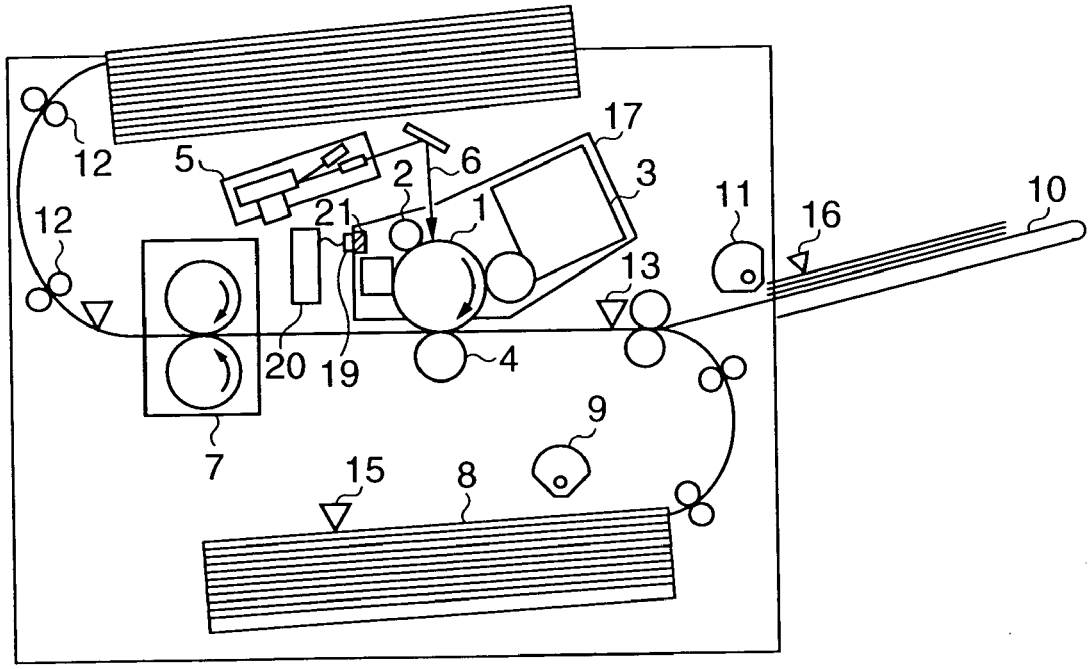
FIG. 1 is a sectional view showing the structure of a printing apparatus according to the first embodiment of the present invention.

FIG. 1 is a sectional view showing the structure of a printing apparatus according to an embodiment of the present invention.

Figure 9:
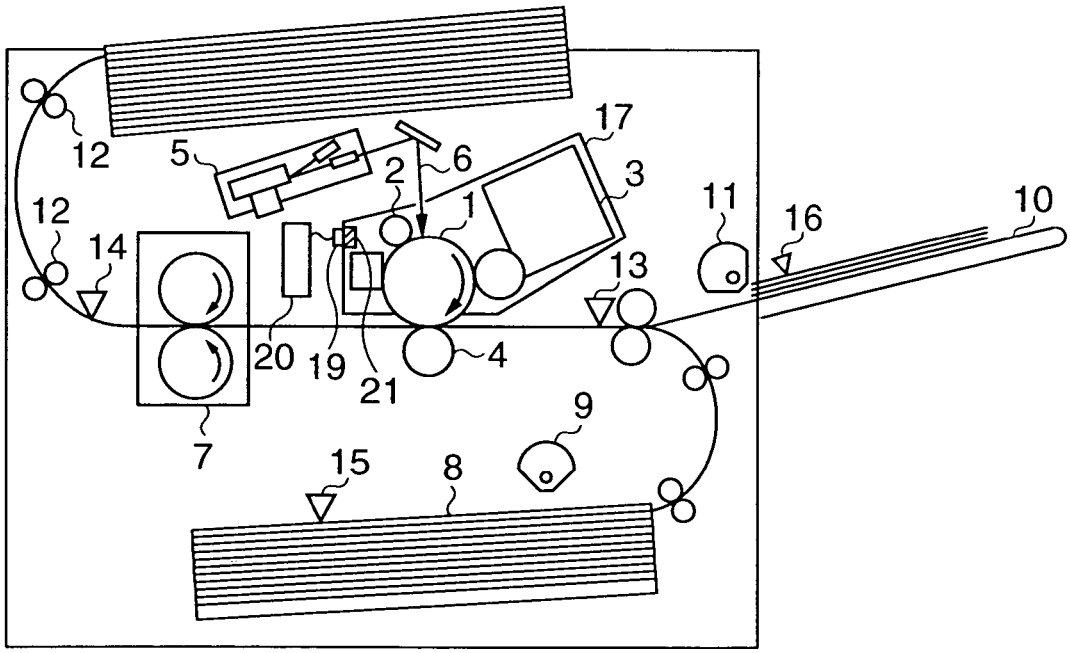
FIG. 9 is a sectional view showing the structure of a conventional printing apparatus.
Figure 10:
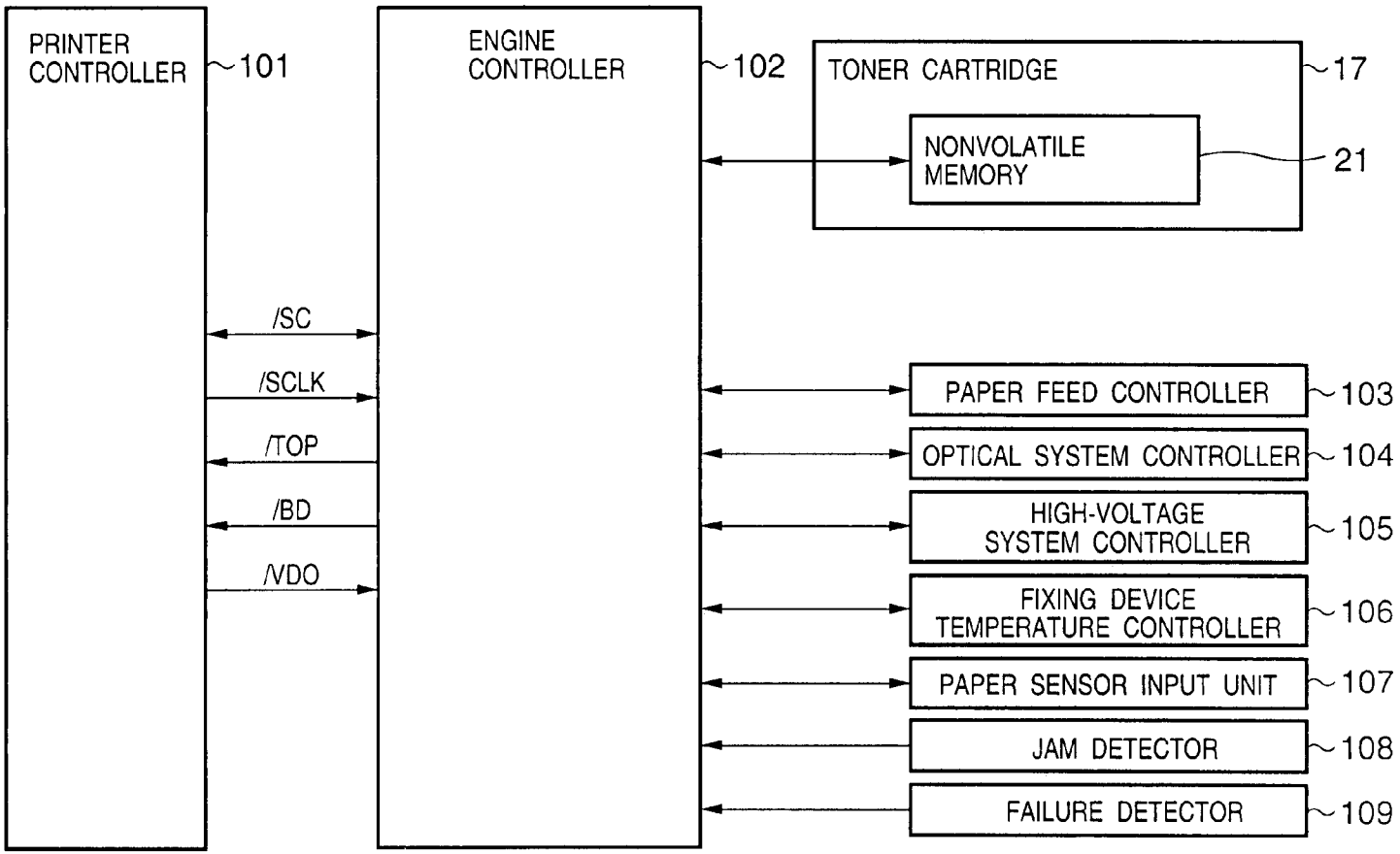
FIG. 10 is a view showing the connection relationship with a conventional toner cartridge.
Figure 11:
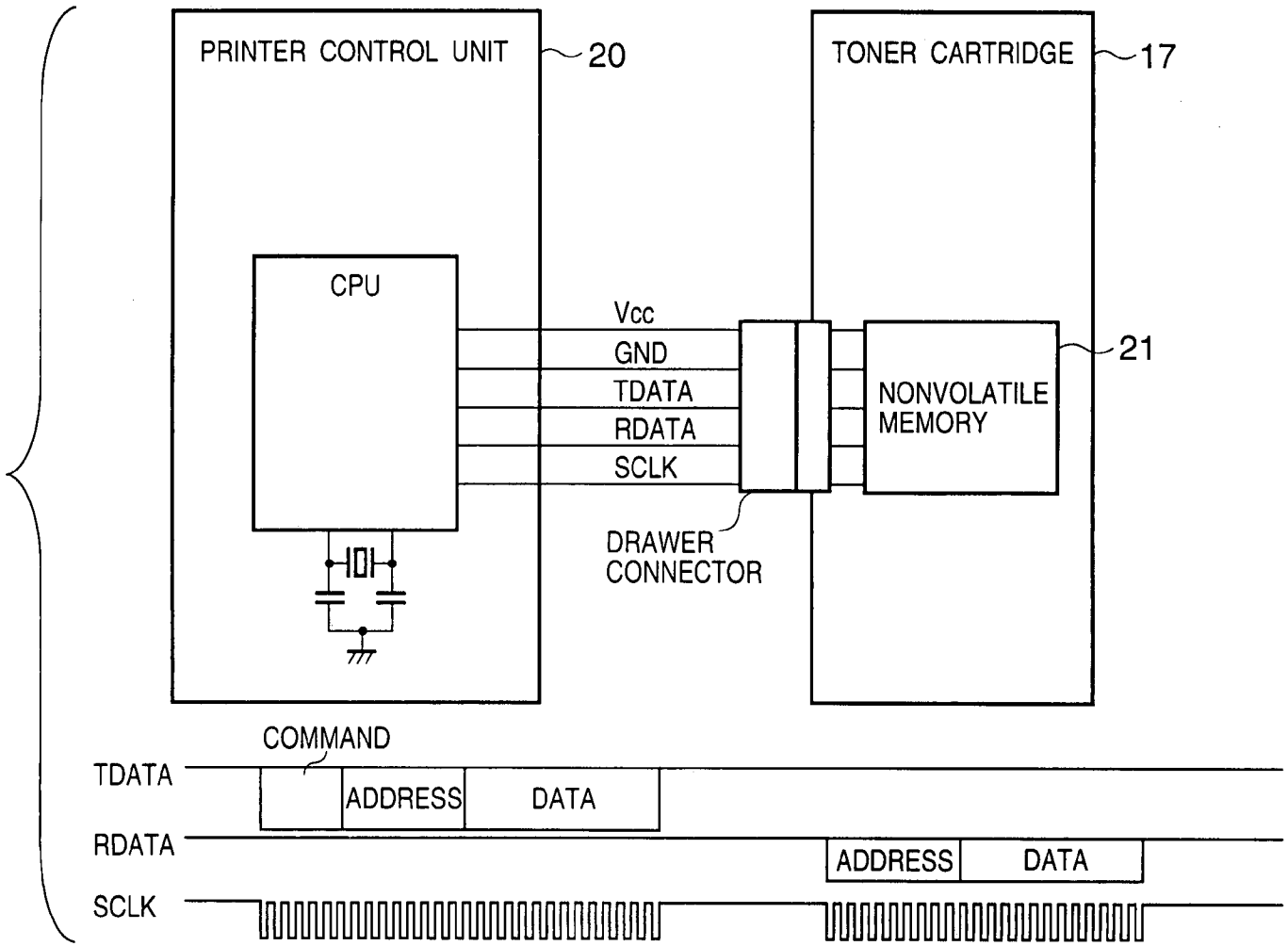
FIG. 11 is a view showing the connection relationship with a memory in the conventional toner cartridge.

The same reference numerals in FIG. 1 denote substantially the same parts as in FIG. 9 described previously, and respective building components are as follows.

Reference numeral 1 denotes a photosensitive drum for forming an electrostatic latent image; 2, a charging roller for uniformly charging the photosensitive drum 1; 5, an optical unit for scanning a laser beam on the surface of photosensitive drum 1; 6, a laser beam emitted by the optical unit 5; 3, a developer for developing an electrostatic latent image formed on the photosensitive drum 1 by toner; 4, a transfer roller charger for transferring a toner image on the photosensitive drum 1 onto a predetermined paper sheet; 7, a fixing device for melting and fixing toner on the paper sheet; 8, a standard cassette for storing a stack of paper sheets used in a print process; 9, a standard cassette feed roller for picking up a paper sheet from the standard cassette; 10, a manual insert tray; 11, a manual insert feed roller; 12, exhaust rollers for exhausting the paper sheet outside the apparatus; 13, a registration sensor for registering the leading end of a fed paper sheet in a print process; 14, an exhaust sensor for confirming if a paper sheet has normally been exhausted from the fixing device; 15, a sensor for detecting the presence/absence of paper sheets in the standard cassette; 16, a sensor for detecting the presence/absence of paper sheets to be manually inserted; 17, a toner cartridge which integrates the photosensitive drum 1, charging roller 2, developer 3, and toner, and is detachable from the printer main body; and 21, a one-chip nonvolatile memory mounted on the cartridge. The nonvolatile memory 21 has a function (lock functional unit 21*a* shown in FIG. 3) of inhibiting predetermined address contents from being rewritten. The function of the nonvolatile memory 21 will be described in detail later. Reference numeral 19 denotes a connector for exchanging signals with the nonvolatile memory 21; and 20, a printer control unit for reading/writing data from/to the nonvolatile memory via the connector. The printer control unit has a function of writing information indicating the service life of the cartridge has expired in the memory, and setting to inhibit the memory from rewriting that information, when the use amount of the toner cartridge (expendable; to be described later) has exceeded a predetermined value.

Figure 2:
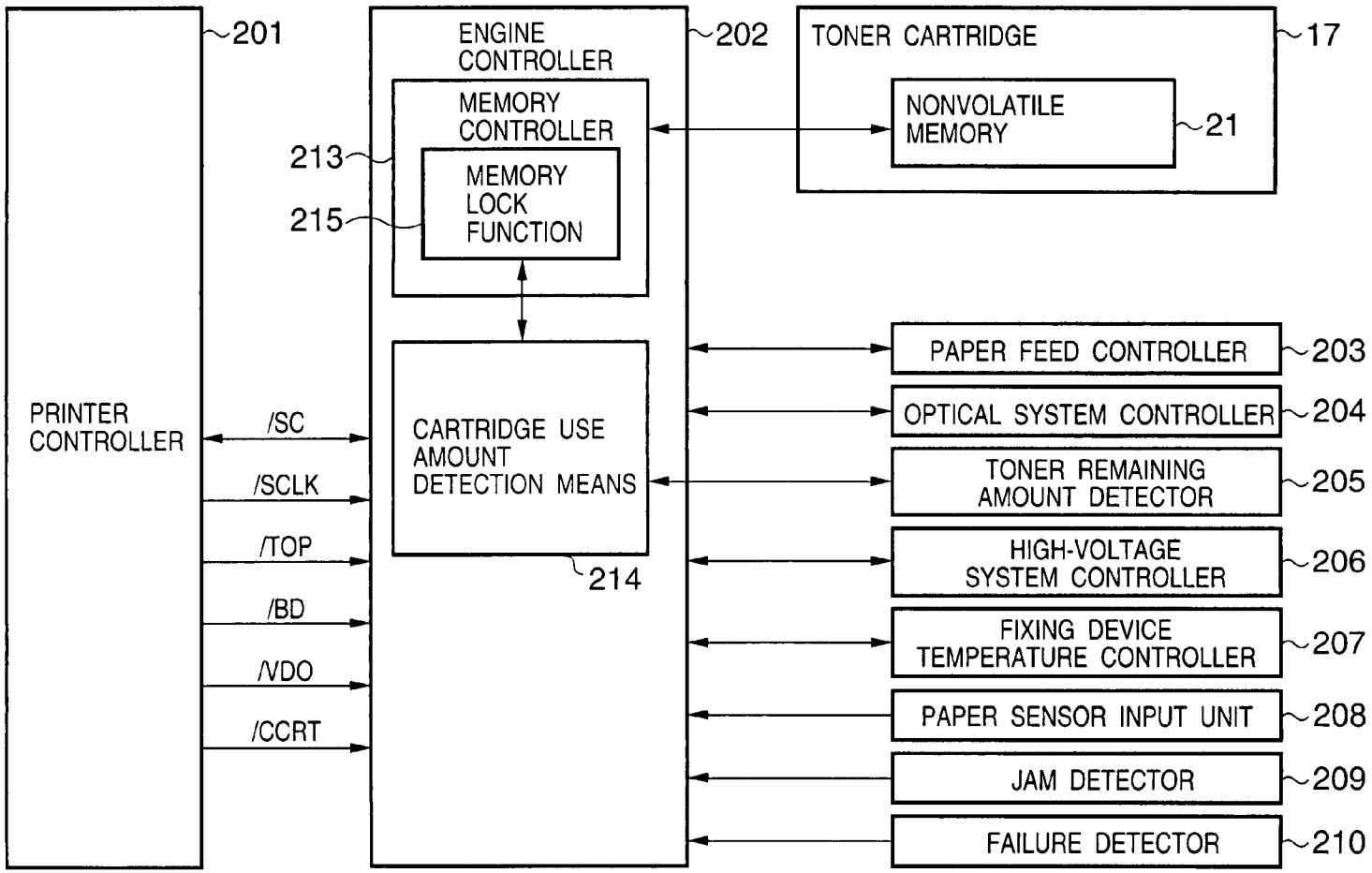
FIG. 2 is a block diagram of a controller and its peripheries in the first embodiment.

FIG. 2 is a block diagram of the printer control unit 22 and its peripheries in this embodiment.

Referring to FIG. 2, reference numeral 201 denotes a printer controller for receiving image data via communications with a host computer, mapping the received image data to information that the printer can print, exchanging signals with a printer engine controller (to be described below) via serial communications; and 202, an engine controller for exchanging signals with the printer controller via serial communications to control respective units of a printer engine.

Reference numeral 203 denotes a paper feed controller for executing paper feed control when a paper sheet to be printed is fed and conveyed until the paper sheet is exhausted after the print process, on the basis of an instruction from the engine controller 202; 204, an optical system controller for executing drive control of a scanner motor and laser ON/OFF control on the basis of an instruction from the engine controller 202; 205, a toner remaining amount controller for detecting the toner remaining in the cartridge, and supplying the detected information to the engine controller 202; 206, a high-voltage system controller for executing high-voltage output control required for electrophotographic processes such as charging, development, transfer, and the like on the basis of an instruction from the engine controller 202; 207, a fixing temperature controller for executing temperature control of the fixing device on the basis of an instruction from the engine controller, and detecting any abnormality or the like of the fixing device; 208, a paper sensor input unit for transferring information from the paper sensors in the paper feed unit and paper convey path to the engine controller 202; 209, a jam detector for detecting convey errors during paper convey; 210, a failure detector for detecting any failure of a functional unit in the printer; and 17, a toner cartridge which is detachable from the printer engine. The toner cartridge 17 mounts the nonvolatile memory 21 which can exchange data with the engine controller, and can read out or write data from or in the engine controller 202. Reference numeral 213 denotes a memory controller which is included in the engine controller 202, and reads out data from the nonvolatile memory 21 and rewrites the contents of the memory 21; 214, a toner use amount detection means which is included in the engine controller 202, and checks the service life of the toner cartridge 17 on the basis of information from the toner remaining amount detector 205 and supplies that information to the memory controller; and 215, a memory lock controller which is included in the memory controller and executes a process for writing service life data in the nonvolatile memory in the cartridge on the basis of service life information from the toner use amount detection means, and inhibiting the memory from rewriting the written data at a predetermined timing. Further, the printer controller 20 corresponds to the engine controller 202 and the other kinds of controllers 203 to 210.

Figure 3:
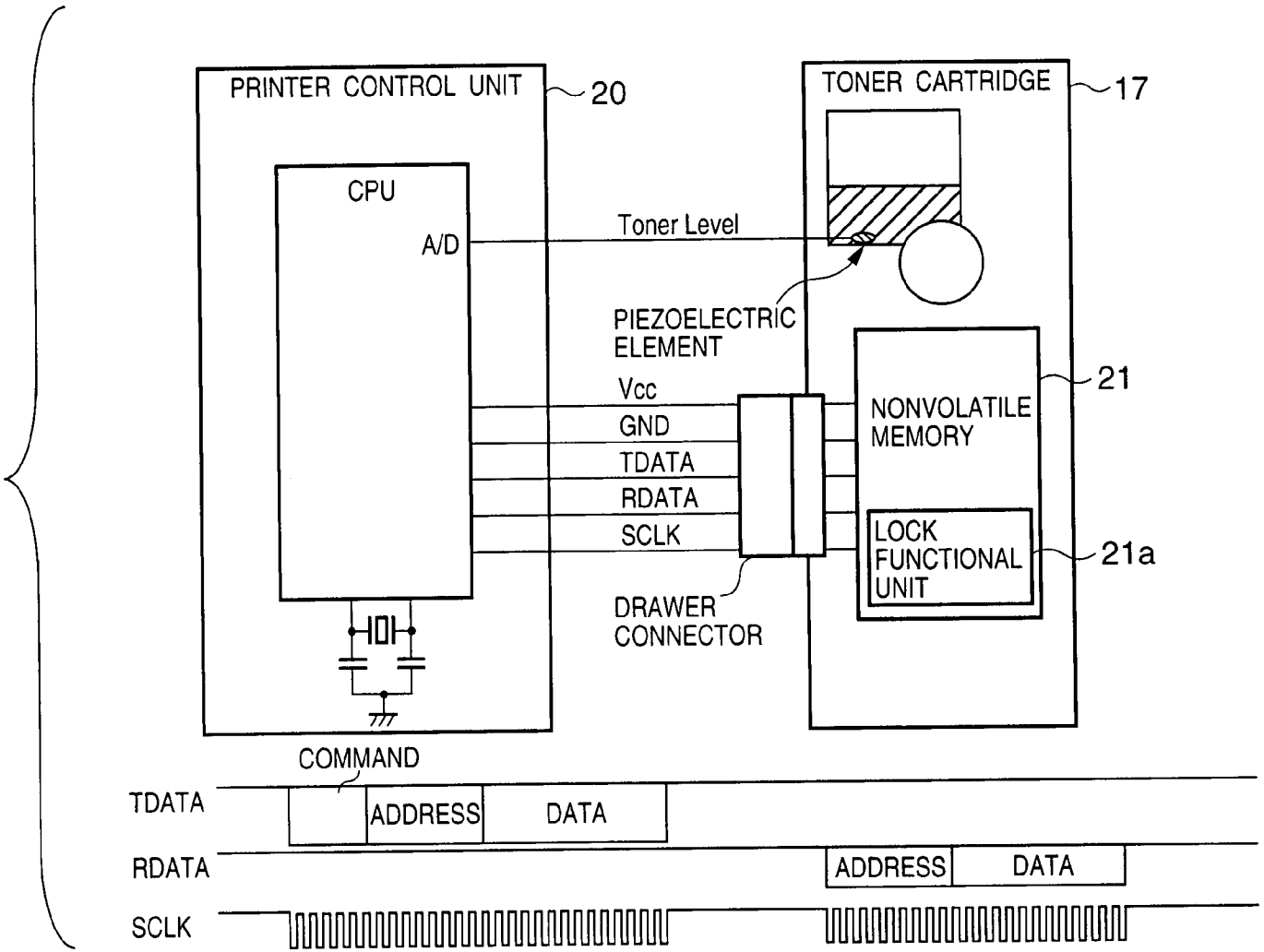
FIG. 3 is a view showing the connection relationship between a printer control unit and toner cartridge in the first embodiment.

FIG. 3 shows signals exchanged between the printer control unit and nonvolatile memory in this embodiment. The printer control unit includes a CPU, which is connected to the nonvolatile memory in the toner cartridge by serial communication lines via a drawer connector. The toner amount that remains in the developer of the cartridge 17 is detected as an analog value using a piezoelectric element or the like, and that analog value is read from an A/D conversion port of the CPU and is digitally processed.

The serial communication lines are formed of signal lines of TDATA serving as command data to be output from the printer control unit to the nonvolatile memory, RDATA serving as return status from the nonvolatile memory, and SCLK serving as a sync clock. TDATA is issued when the printer control unit reads out the contents of the nonvolatile memory and rewrites its contents, and a read/rewrite instruction is set using command bits. The read address and rewrite data are output serially. When data is to be read out from the nonvolatile memory, a command indicating read and an address are issued. In response to this command, the cartridge returns that address and the readout data. When the contents of the memory are to be rewritten, a command indicating rewrite, an address, and rewrite data are transferred.

The nonvolatile memory 21 in this embodiment has the aforementioned read/write function, and also a function of inhibiting predetermined data from being rewritten (to be referred to as a memory lock function hereinafter).

FIG. 4 illustrates the address structure in the nonvolatile memory 21 in the cartridge.

For example, eight address areas are available, and the data width is 8 bits.

Memory lock to inhibit data write is set on the basis of the data of a specific address in an address space, namely, by writing the predetermined data in an area of address No. 7, the contents of areas of address Nos. 1 to 4 are inhibited from being rewritten. According to the present embodiment, each of areas of address Nos. 1 to 4 is not set up independently. Also, the area of address No. 8 setting memory lock of areas of address Nos. 5 to 8, does not allow different setups in units of addresses No. 5 to 8 by writing the predetermined data to address No. 8. Hence, when data is written in address No. 8, the contents of the areas of address Nos. 5 to 8 cannot be rewritten, and the memory lock set ups of address Nos. 1 to 4 cannot consequently be changed.

Upon delivery of the cartridge, the Lot No. of the cartridge is written at address No. 1 in the place of manufacture, and the contents at address Nos. 1 to 4 are locked by the contents at address No. 7.

On the other hand, when the cartridge is attached to the printer main body, the printer engine accesses the nonvolatile memory 21 at given cycles by the aforementioned toner remaining amount detection means, and writes remaining amount data in an area of address No. 5 indicating the toner remaining amount in the cartridge. At this time, when the toner remaining amount has not reached a predetermined toner remaining amount level at which the service life of the toner cartridge is checked, no memory lock setup is made at address No. 8, and the toner remaining amount level that changes based on the print amount of the printer is rewritten by overwriting the contents at address No. 5 at a predetermined timing, so that the latest remaining amount data can always be stored.

When it is determined that the toner remaining amount has become equal to or lower than the predetermined level, data indicating that the toner cartridge service life has expired is set at address No. 6, and a memory lock setup is made at address No. 8, thus inhibiting the contents of all the addresses from being rewritten.

Note that the lock functional unit 21*a* that permits/inhibits write to the memory using the contents at address Nos. 7 and 8 may be implemented by the following processes.

For example, upon writing data at address No. 1, a write command, write address, and write data are sent from the engine controller 202 in this order via serial communications. Accordingly, before receiving the data to be written, the write command has been received. Hence, upon receiving the write command, data is read out from addresses Nos. 7 and 8 of the nonvolatile memory 21. Then, it is determined whether or not the read data corresponds to a memory lock setup. For example, if data in the address No. 7 corresponds to a memory lock setup, and if the subsequently received write address signals are one of addresses Nos. 1 to 4, the write address and the data to be written are not passed through. Or else, the write address and the data to be written will be passed through. This process will be accomplished by appropriate logic gate circuits.

Figure 5:
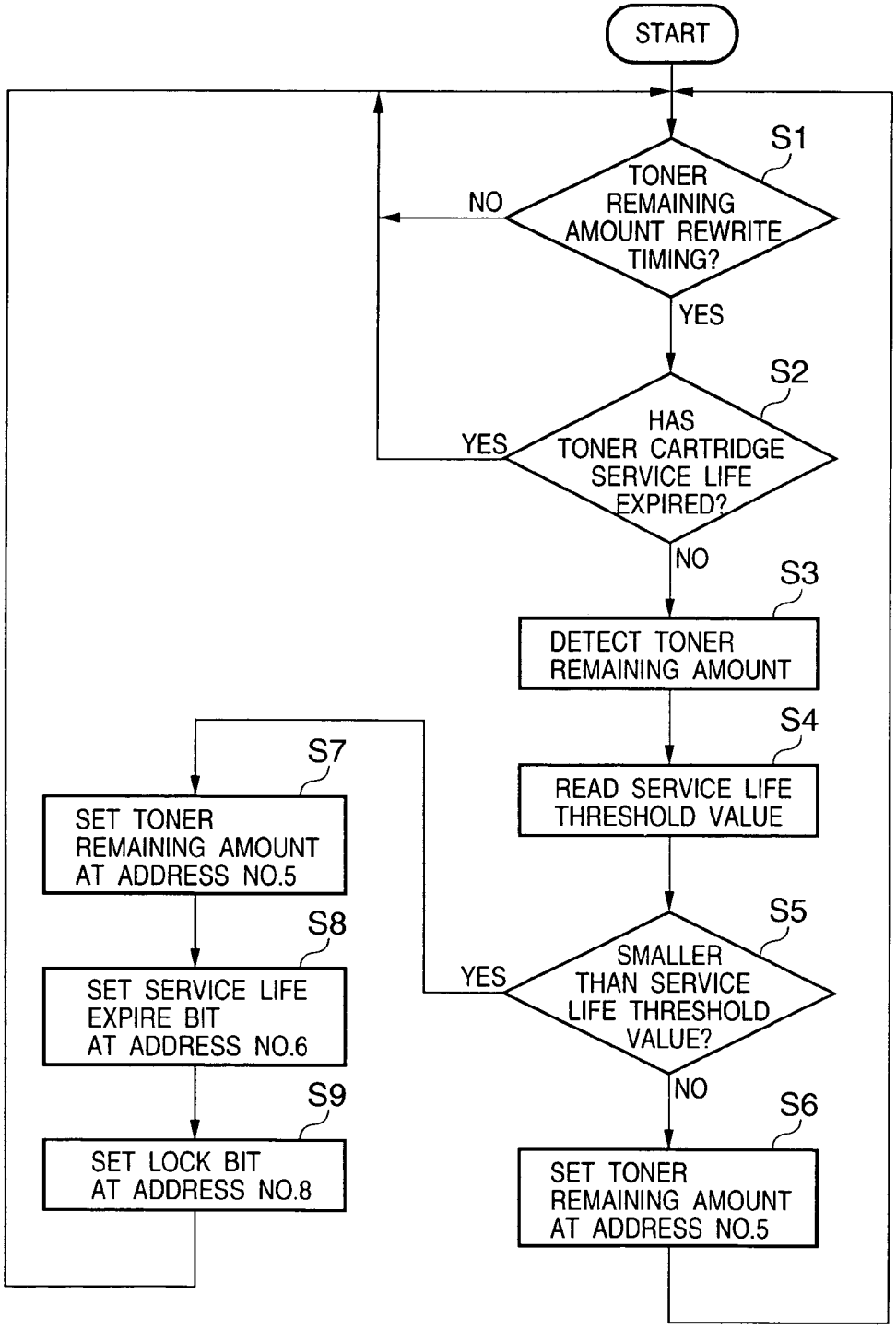
FIG. 5 is a flow chart showing the operation processing contents in the first embodiment.

Next, the process of the memory lock control unit 215 is explained. FIG. 5 is a flow chart showing the aforementioned process.

It is checked in step S1 if the rewrite timing of the toner remaining amount has been reached. This timing is determined by checking if a predetermined timing after, e.g., print processes for 10 pages have been executed, is reached. If the rewrite timing has been reached, the flow advances to step S2 to check by reading data at address No. 6 in the nonvolatile memory if the cartridge service life has expired. If the service life has expired, the subsequent process is canceled.

If the service life has not expired yet, the flow advances to step S3 to detect the toner remaining amount. A pre-set threshold value is read out from the internal ROM of the engine controller 202 in step S4, and is compared with the detected toner remaining amount in step S5. If it is determined that the toner remaining amount is larger than the threshold value, the detected toner remaining amount is written at address No. 5 in the nonvolatile memory 21, thus ending this process.

If it is determined that the toner remaining amount is equal to or smaller than the threshold value, it is determined that the service life of the toner cartridge has expired, the toner remaining amount is written at address No. 5 in step S7, and information indicating that the service life has expired is written at address No. 6 in step S8. Furthermore, a memory lock setup is written at address No. 8. With the aforementioned process, data indicating that the service life of the toner cartridge has expired can be temporarily memory-locked.

MODIFIED EXAMPLE

The lock functional unit 21*a* of the nonvolatile memory 21 in the toner cartridge 17 can be implemented by the aforementioned appropriate gate circuit, but they can also be implemented by a processor using software. Also, an example of the arrangement and processing sequence in such case will be explained below.

Figure 12:
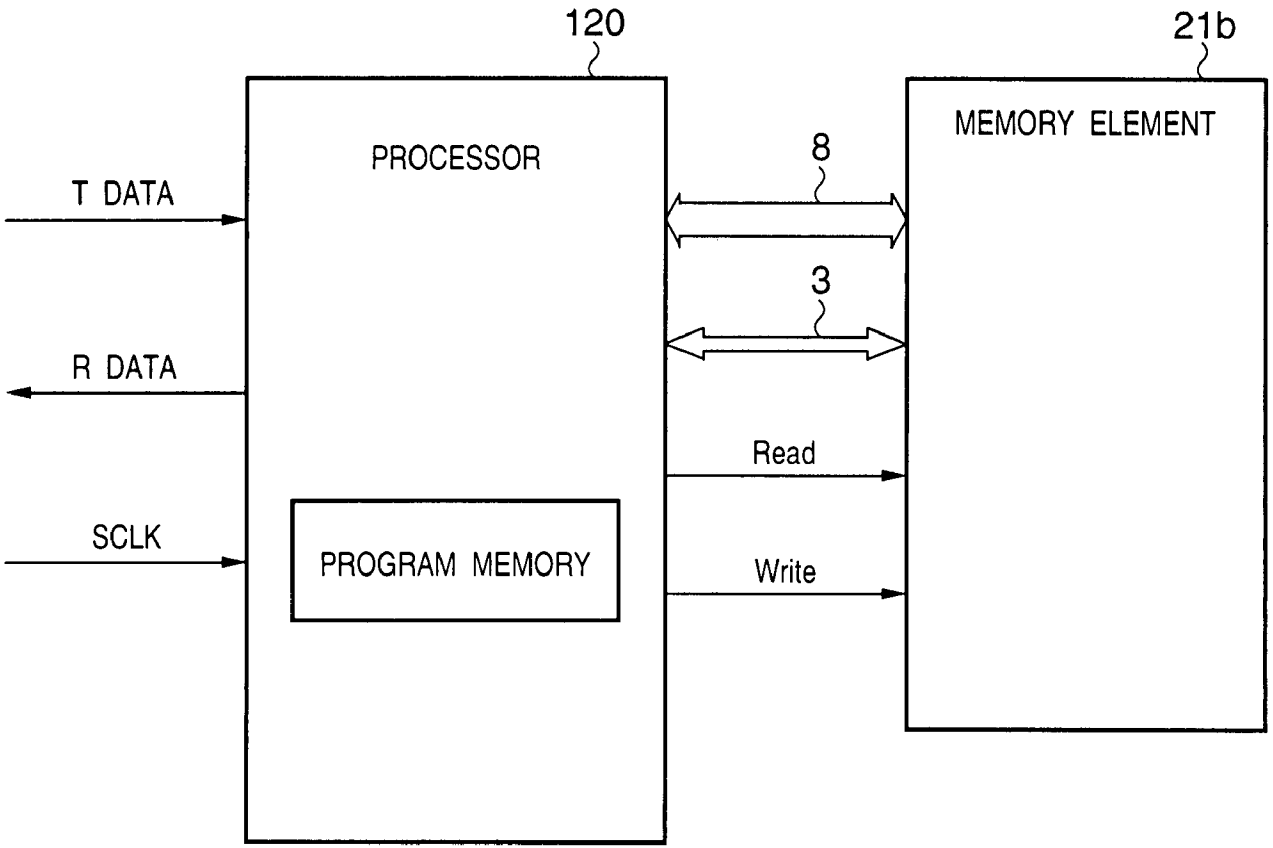
FIG. 12 is a diagram showing the arrangement of a nonvolatile memory and lock functional unit in a toner cartridge in the embodiment of the present invention.

The lock functional unit 21*a* is implemented by a processor 120, as shown in FIG. 12. The processor 120 comprises a program memory (ROM and RAM) which stores a program of that operation process, and is also used as a simple work memory. The processor 120 is connected to the memory element 21*b* of the nonvolatile memory 21 via an 8-bit bus and 3-bit address bus, and read and write signal lines are connected therebetween.

Figure 13:
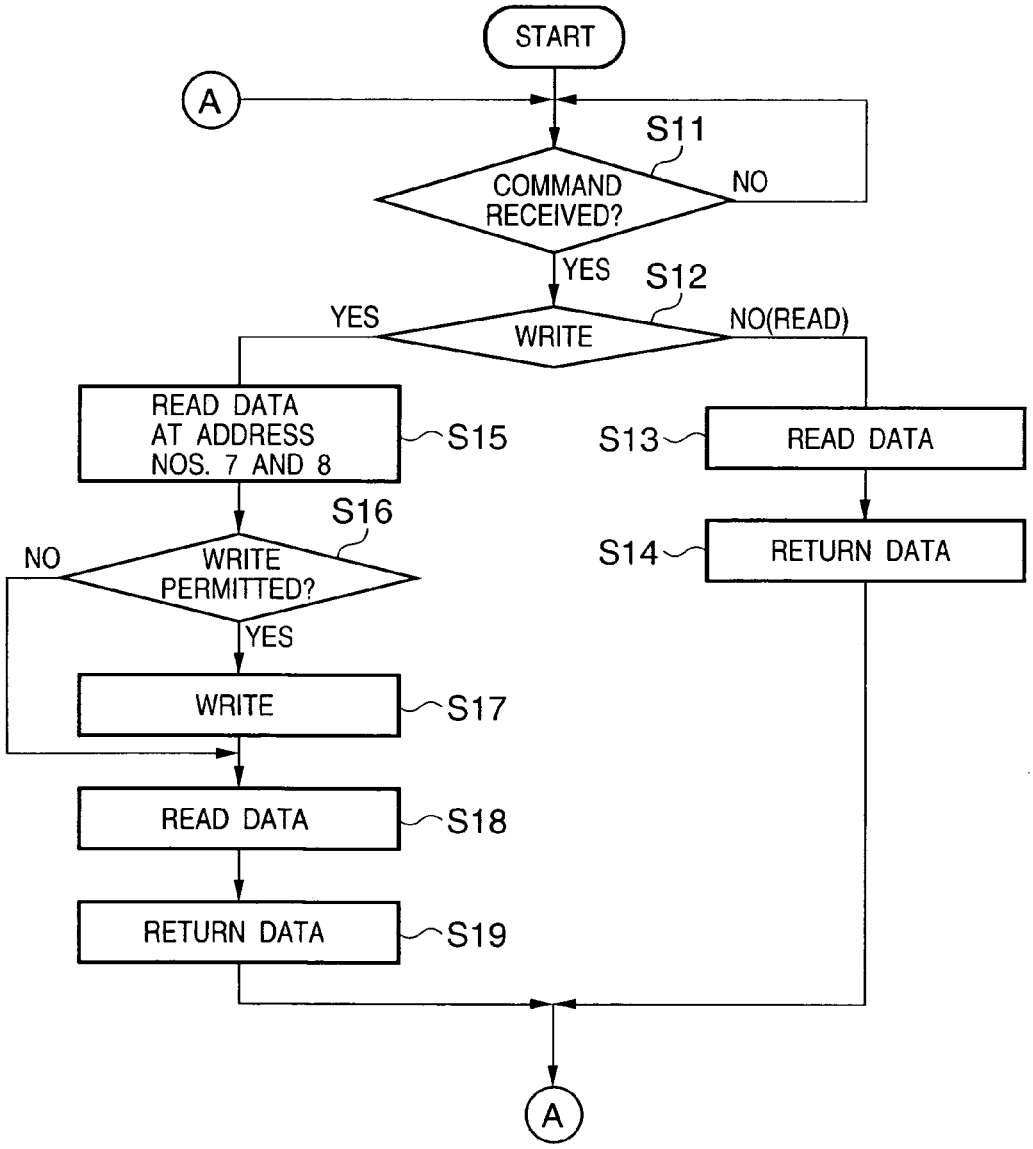
FIG. 13 is a flow chart showing the processing sequence of the lock functional unit.

The operation process sequence of the processor 120 will be explained below with reference to the flow chart in FIG. 13. A power supply required for operating the processor 120 uses a Vcc signal from the printer control unit.

In step S11, the control waits for TDATA received from the printer control unit 22. Upon receiving TDATA, the flow advances to step S12 to determine by checking the first command of TDATA if TDATA is a write or read instruction. If it is determined that TDATA is a read instruction, the flow advances to step S13 to output the address (one of 0 to 7) contained in TDATA to the nonvolatile memory 21 and also output a read signal, thus reading out data at the corresponding address. The designated address and readout data are returned to the printer control unit 22 as RDATA. The reason why not only data but also the address are returned is that the printer control unit 22 can check if the data is the one at the designated address.

If it is determined in step S12 that the received TDATA contains a write instruction command, the flow advances to step S15. In step S15, data at address Nos. 7 and 8 of the nonvolatile memory 21 are read out. It is checked in step S16 if the write address position contained in TDATA is a write inhibition position. If that address position is a write permission position, the flow advances to step S17 to write the write data contained in TDATA at the designated address position. The data at the write address position is read in step S18, and the write address and data read out from that write address are returned as RDATA to the printer control unit 22 in step S19. As a result, the printer control unit 22 can check if data is normally written, since the write address and data written at that address are returned.

If it is determined in step S16 that the received TDATA contains a write instruction command, and the write address position is a write inhibition position, the process in step S17 is skipped, and the processes in steps S18 and S19 are executed. That is, data at the address where write might be made is read, and the write address and read data are returned as RDATA.

As a result, when the printer control unit 22 outputs TDATA to read or write data, the address and data are returned from the toner cartridge in either case.

Second Embodiment

The second embodiment will explain a case wherein a wireless communication function is used between the nonvolatile memory 21 and printer control unit 20.

Figure 6:
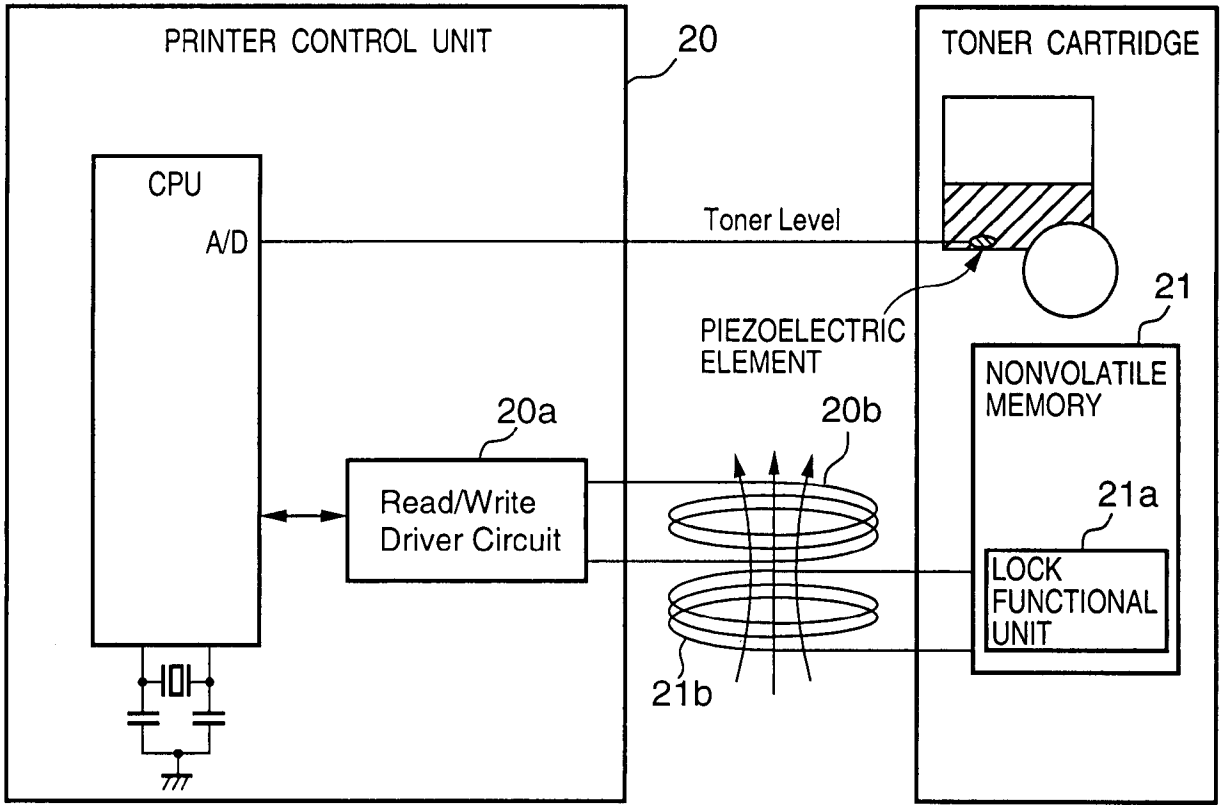
FIG. 6 is a view showing the connection relationship between a printer control unit and toner cartridge in the second embodiment of the present invention.

FIG. 6 shows the interface between the printer control unit 20 and a wireless memory.

Toner level detection is done in the same manner as in the first embodiment.

In the second embodiment, the interface between the nonvolatile memory 21 and printer control unit 20 has a wireless arrangement, i.e., has no electrical contacts. For this reason, the read/write driver circuit 20*a* is mounted in the printer control unit 20 and it is connected to the coil antenna 20*b*. The cartridge has an antenna 21*b* in coil-shape, which is connected to the nonvolatile memory 21 and is located at a position opposite to the antenna 20*b* when attaching to the printer. The communication is established by electromagnetical coupling between antenna 20*b* and 21*b*.

In principle, magnetic field generated by flowing a predetermined modulated current to the coil 20*b* causes electric power on the coil 21*b* connected to the nonvolatile memory 21. The memory operates by that electric power. The current which flows on the printer controller 20 side undergoes amplitude modulation at a modulation factor of around 10% with respect to the carrier amplitude, and data is sent to the memory 21 by that modulation. The memory 21 determines data to be returned on the basis of the received data, and digitally switches the impedance of the coil 20*b* connected thereto. The change in impedance changes the electromagnetic coupling coefficient with the coil 20*b* on the printer control unit 20 side, and the read/write driver circuit on the printer control unit 20 side detects the change so that the contents of the memory can be received.

The read/write driver circuit 20*a* and the CPU of the printer controll unit 20 are coupled via clock-synchronized serial communications. That is, the read/write driver circuit 20*a* generates a modulated current or the received data of the serial communication with the CPU, so it has a function of converting the change in impedance received from the memory 21 into a protocol of the serial communication with the CPU.

The contents of the storage memory and the like are the same as those in the first embodiment, and the memory lock process can provide the same effect as described above even when the memory is of wireless type.

Third Embodiment

The third embodiment will explain a case wherein memory lock setups for inhibiting memory rewrite are made in accordance with an instruction from the printer controller in place of determination by the engine controller.

Figure 7:
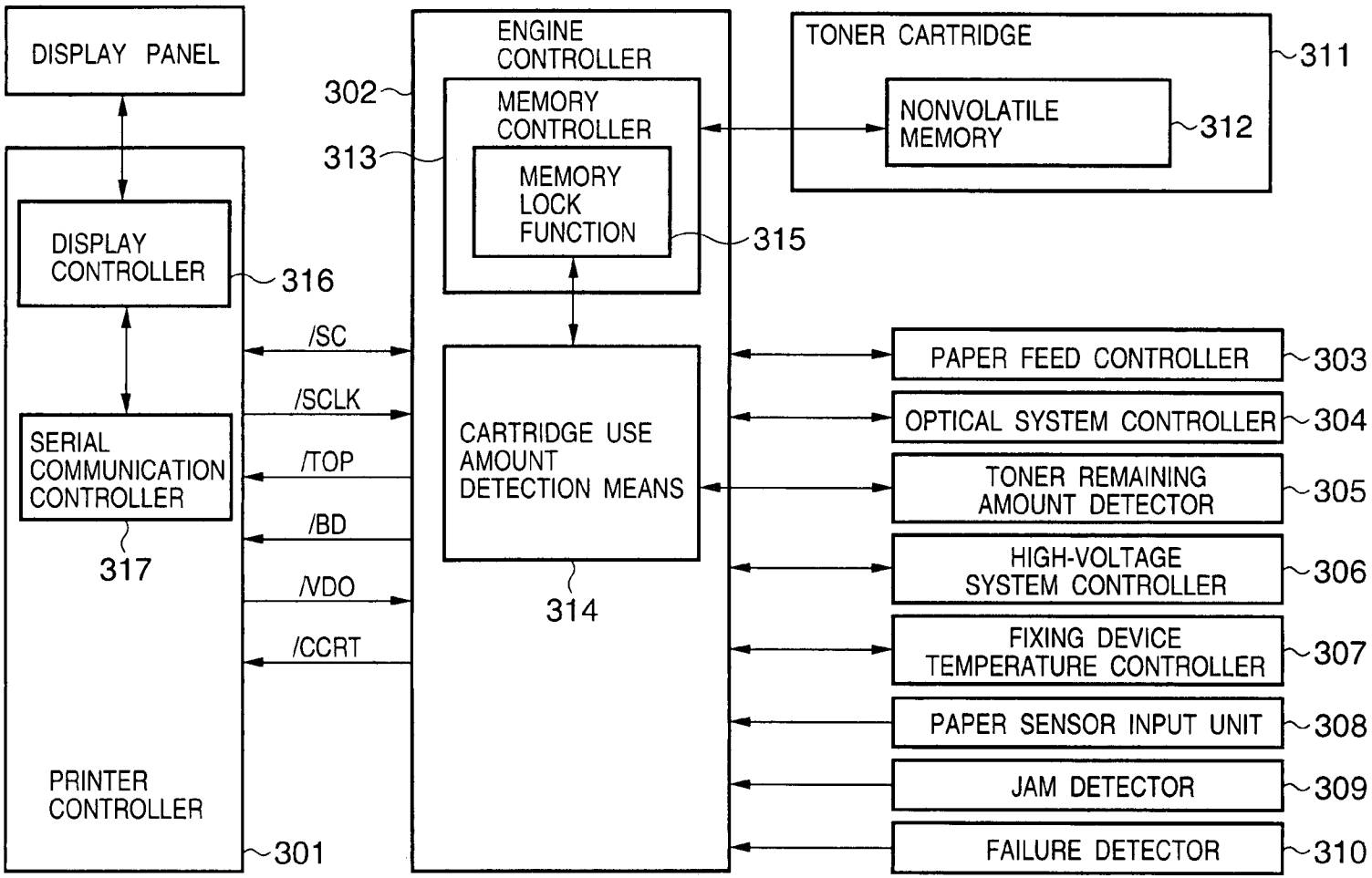
FIG. 7 is a block diagram of a controller and its peripheries in the third embodiment of the present invention.

FIG. 7 is a block diagram showing the interface between the engine controller and printer controller, and that with the memory.

Referring to FIG. 7, reference numeral 301 denotes a printer controller for receiving image data via communications with a host computer, mapping the received image data to information that the printer can print, and exchanging signals with a printer engine controller (to be described below) via serial communications. The printer controller 301 has a function of displaying a message on a display panel when it is determined based on the serial communication contents from the engine controller that the use amount of the toner cartridge has exceeded a predetermined value, thus informing the user that the service life has expired. Also, the printer controller 301 has a function of asking the user via the display panel if the cartridge is exchanged, and sending a memory lock instruction to the engine controller when the user instructs to exchange the cartridge.

Reference numeral 302 denotes an engine controller for exchanging signals with the printer controller 301 via serial communications to control respective units of a printer engine.

Reference numeral 303 denotes a paper feed controller for executing paper feed control from when a paper sheet to be printed is fed and conveyed until the paper sheet is exhausted after the print process, on the basis of an instruction from the engine controller; 304, an optical system controller for executing drive control of a scanner motor and laser ON/OFF control on the basis of an instruction from the engine controller 302; 305, a toner remaining amount controller for detecting the toner remaining amount in the cartridge, and supplying the detected information to the engine controller 302; 306, a high-voltage system controller for executing high-voltage output control required for electrophotographic processes such as charging, development, transfer, and the like on the basis of an instruction from the engine controller 302; 307, a fixing temperature controller for executing temperature control of the fixing device on the basis of an instruction from the engine controller 302, and detecting any abnormality or the like of the fixing device; 308, a paper sensor input unit for transferring information from the paper sensors in the paper feed unit and paper convey path to the engine controller 302; 309, a jam detector for detecting convey errors during paper convey; and 310, a failure detector for detecting any failure of a functional unit in the printer.

Reference numeral 311 denotes a toner cartridge which is detachable from the printer engine in the third embodiment. This toner cartridge mounts a nonvolatile memory 312 which can exchange data with the engine controller 302, and allows the engine controller 302 to read out or write data.

Reference numeral 313 denotes a memory controller which is included in the engine controller 302, and reads out data from the nonvolatile memory 312 and rewrites the contents of the memory 312; 314, a toner use amount detection means which is included in the engine controller 302, and checks the service life of the toner cartridge on the basis of information from the toner remaining amount detector 305 and supplies that information to the memory controller 313; and 315, a memory lock function which is included in the memory controller 313 and executes a process for writing service life data in the nonvolatile memory in the cartridge on the basis of service life information from the toner use amount detection means 314, and inhibiting the memory from rewriting the written data at a predetermined timing.

Reference numeral 316 denotes a display controller which displays a message on the display panel upon receiving service life information of the toner cartridge from the engine controller 302, and asks the user if the toner cartridge is exchanged; and 317, a serial communication controller for sending a memory lock instruction of the memory contents to the engine controller when the user inputs "yes" in response to the inquiry about exchange of the cartridge.

FIG. 8 shows the serial communication between the engine controller 302 and printer control unit and return status from the engine controller 302.

When a toner cartridge service life expire bit is set, the controller 301 informs the user of the service life via the display, and confirms the presence/absence of exchange, as described above. Upon receiving a reply that instructs exchange via a switch on a control panel or the like, the controller sends a memory lock instruction of the memory contents to the engine controller 302.

Note that the present invention is applied to a printer connected to a host computer. However, the present invention is not limited to such specific apparatus, but may be applied to a printing unit of a copying machine, facsimile, and the like.

In this embodiment, a toner cartridge has been exemplified as an expendable. However, the present invention is not limited to this. For example, in case of an ink-jet printing apparatus, the present invention may be applied to an ink cartridge, and the present invention is not limited by such expendables.

As described above, according to this embodiment, since a recording medium such as a memory is used, the memory being characterized in that when an expendable including the recording medium has reached a predetermined condition, write to a predetermined area is inhibited in accordance with an instruction from a printer controller, and the write inhibition state is also inhibited from being changed, security of important control data can be improved without increasing the memory size, unlike in the prior art. This results in improved quality of the printer system and a cost reduction.

Fourth Embodiment

The fourth embodiment will explain a case wherein data in a plurality of areas of the memory in the toner cartridge are locked at different timings under a plurality of conditions.

Areas to be locked as a printer include a bit indicating whether or not the cartridge is a new one, toner LOW, toner OUT, and initial installation date data as shown in FIG. 15.

These data are sequentially locked depending on the following use conditions.

1. When a new cartridge is installed in the engine main body, the controller reads the "new cartridge bit" in the cartridge memory, and instructs the engine to write the "initial installation date" data if the read data is "01h".

2. Upon receiving a write request of an "initial installation date" data from the controller, the printer control unit rewrites the contents at the address containing the "new cartridge bit" in the nonvolatile memory of the toner cartridge from "01h" to "00h" so that it sets the $1^{st}$ bit of the address FFh to "new cartridge bit" and locks that bit.

3. The printer control unit then writes the "initial installation date" data at the corresponding address position of the nonvolatile memory so that it sets the $2^{nd}$ bit of the address Ffh to "1" to "initial installation date", and locks that data.

4. After that, when the printer is used and the toner remaining amount has reached a predetermined remaining amount N %, the printer control unit writes "toner LOW" data and locks that information by setting a "1" to the $3^{rd}$ bit of the address FFh.

5. When the toner cartridge is further used and the toner remaining amount has reached M % smaller than N %, the printer control unit writes "toner OUT" data and locks that information by turning "1" to $4^{th}$ bit of the address FFh.

In this way, data in a plurality of areas are locked at different times under different conditions.

Figure 14:
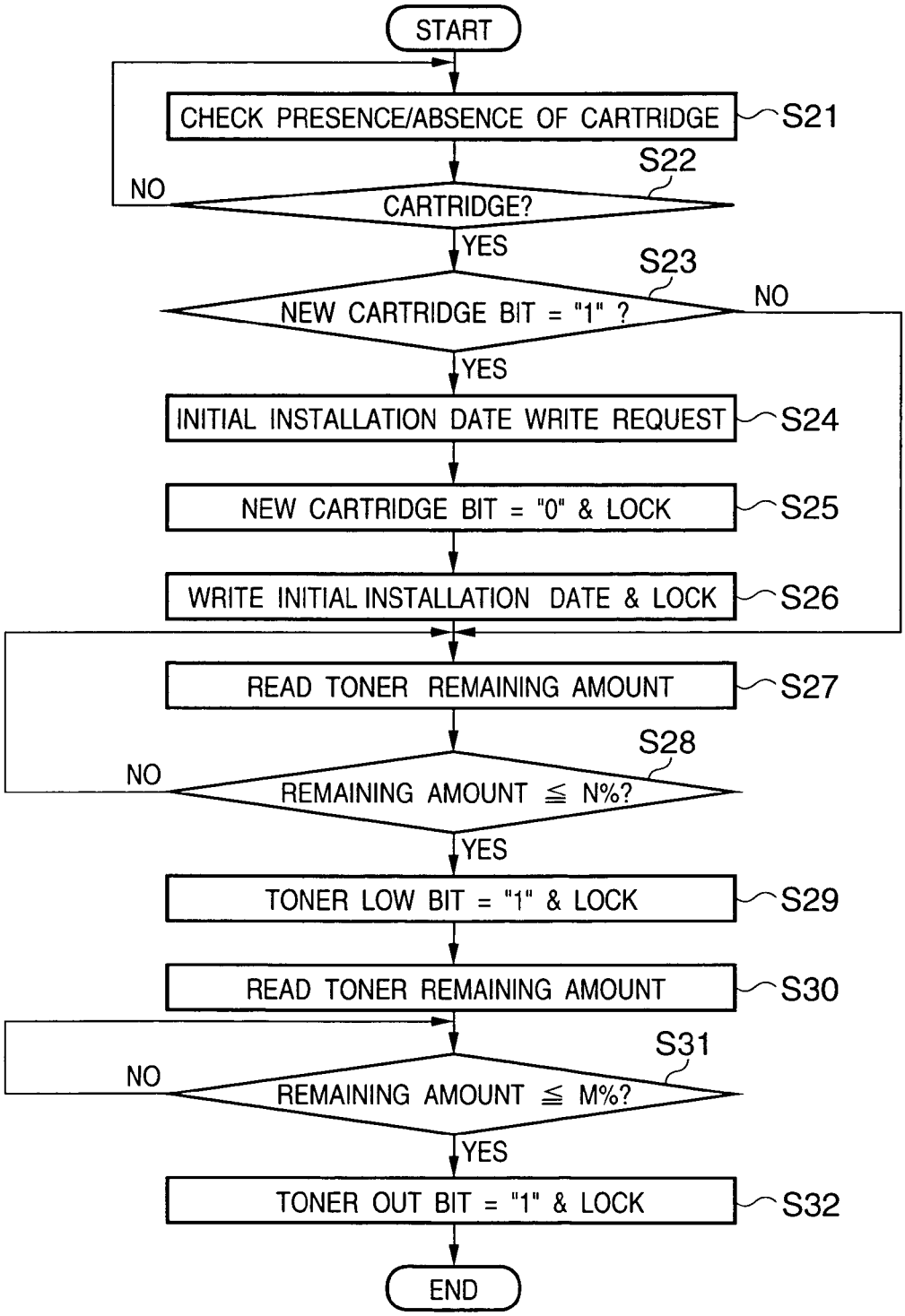
FIG. 14 is a flow chart showing the operation processing sequence in a printer control unit in the fourth embodiment of the present invention.

FIG. 14 is a flow chart showing the operation processing sequence of the printer control unit in the fourth embodiment. For the sake of simplicity, the printer control unit and expendable (toner cartridge) have the same arrangement as that shown in FIG. 3 or FIG. 6.

In step S21, the presence/absence of a toner cartridge 17 is checked. If it is determined in step S22 that a toner cartridge 17 is attached, the flow advances to step S23. In step S23, data at the address indicating if the cartridge is a new one in the nonvolatile memory of the toner cartridge is read out, and it is checked if the readout data is "1". This checking step is achieved by issuing TDATA and receiving RDATA. If it is determined that the toner cartridge is a new one, the flow advances to step S24 to write today's date at the address position in the nonvolatile memory where "initial installation date" is stored. In step S25, "0" is written at the address position indicating a new cartridge. The flow then advances to step S26 to lock the address of "initial installation date". In order to lock the address, data is set at an address that manages write permission at the address of "initial installation date".

The flow then advances to step S27 to detect the toner remaining amount of the toner cartridge. If it is determined that the detected remaining amount is equal to or smaller than N %, "1" is written at the address position in the nonvolatile memory, which indicates that the remaining amount has reached N % or less, and that address position is locked.

In steps S30 to S32, if it is determined that the toner remaining amount of the toner cartridge has become M % or less (M<N), "1" is written at the address in the nonvolatile memory, which indicates toner OUT, and that address is locked.

As described above, according to the present invention, control is made to inhibit inadvertent write to a memory in an expendable, thus securely managing the exchange timing or the like of the expendable.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus to which an expendable unit, having a memory, including a plurality of memory areas, and a recording agent, is detachably attached, wherein said a plurality of memory areas include a first memory area storing data concerning a use state of the expendable unit, a second memory area storing data concerning a use state of the recording agent and a third memory area storing data for setting inhibition/permission of writing with respect to the first and second memory areas said apparatus comprising:

memory access means for reading from and writing to the memory in the expendable unit; and setting means for setting inhibition of writing with respect to the first and the second memory areas in the memory in the expendable unit by writing predetermined data into the third memory area;

wherein said setting means sets inhibition of writing of the first and the second memory areas, at different timings, on the basis of the use state of the expendable unit and the use state of the recording agent.

2. The apparatus according to claim 1, wherein said memory access means and the memory are connected via a serial communication line.

3. The apparatus according to claim 1, wherein said memory access means and the memory are connected via non-contact communication means.

4. The apparatus according to claim 1, further comprising:

detection means for detecting an amount of the recording agent in the expendable unit; and update means for writing the recording agent amount detected by said detection means in the second memory area of the memory via said memory access means, and wherein said setting means sets to inhibit writing to the second memory area when said detection means detects that the remaining amount of the expendable agent becomes less than a predetermined amount.

5. The apparatus according to claim 4, wherein one or a plurality of predetermined amounts of the recording agent are determined in advance, when each of the predetermined amounts has been reached, data indicating that the predetermined amount has been reached is written in the second memory area corresponding to that predetermined amount at a different timing, and writing to the second memory area is set to be inhibited.

6. A printing apparatus comprising:

detaching/attaching means for detaching or attaching an expendable unit having a recording agent and a memory capable of setting a locking state for inhibiting data writing with respect to a plurality of memory areas in the memory, said a plurality of memory areas including a first memory area storing data concerning a use state of the expendable unit a second memory area storing data concerning a use state of the recording agent and a setting area storing data for setting inhibition/permission of writing with respect to the first and second memory areas;

detection means for detecting a state of the expendable unit and a state of the recording agent;

write means for writing a result detected by said detection means to the memory; and locking state control means for controlling the locking state of the first memory area on the basis of the status of said expendable unit detected by detection means and controlling the locking state of the second memory area on the basis of the use status of the recording agent detected by said detection means.

7. The apparatus according to claim 6, wherein the data communication between said printer and said expendable unit is made by wireless transmission.

8. The apparatus according to claim 6, wherein said detection means detects an amount of an expendable agent in the expendable unit.

9. The apparatus according to claim 6, wherein, when the amount of the recording agent in the expendable unit detected by said detection means reaches a predetermined amount or one of a plurality of predetermined amounts, said write means writes data, indicating that the amount of recording agent has reached the predetermined amounts, in said second memory area of said memory, and said lock state control means sets data into said setting area so that the second memory area of the memory becomes locked.

10. A method of controlling a printing apparatus to which an expendable unit, having a memory, including a plurality of memory areas, and a recording agent, is detachably attached, said plurality of memory areas including a first memory area storing data concerning a use state of the expendable unit, a second memory area storing data concerning a use state of the recording agent and a third memory area storing data for setting inhibition/permission of writing with respect to the first and the second memory areas, said method comprising:

the memory access step of reading from and writing to the memory in the expendable unit; and the setting step of setting inhibition of writing with respect to the first and the second memory areas, at different timings by writing predetermined data into the third memory area on the basis of the use state of the expendable unit and the use state of the recording agent.

11. The method according to claim 10, wherein data communication with said memory in said memory access step is performed by using a serial communication line.

12. The method according to claim 10, wherein data communication with said memory in said memory access step is performed in non-contact manner with said memory.

13. The method according to claim 10, further comprising the detection step of detecting an amount of recording agent in said expendable unit, wherein, in said memory access step, the amount of the recording agent in said expendable unit is written to the second memory area of said memory, and in said setting step, when the amount of the recording agent detected in said detection step is less than a predetermined amount, writing to the second memory area of said memory is set to be inhibited by setting the predetermined data into the third memory area.

14. The method according to claim 13, wherein one or a plurality of predetermined amounts of the recording agent are determined in advance, when each of the predetermined amounts has been reached, data indicating that the predetermined amount has been reached is written in the second memory area corresponding to that predetermined amount at a different timing, and writing to the second memory area is set to be inhibited.

15. A method of controlling a printing apparatus having detaching/attaching means for detaching or attaching an expendable unit having a recording agent and a memory, capable of setting a locking state for inhibiting data writing with respect to a plurality of memory areas in the memory, said a plurality of memory areas including a first memory area storing data concerning a initial use state of the expendable unit, a second memory area storing data concerning a use state of the recording agent and a setting area storing data for setting inhibition/permission of writing with respect to the first and the second memory areas, comprising the steps of:

the detection step of detecting a use state of the expendable unit and a use state of the recording agent;

the write step of writing the result detected in said detection step to the memory; and the locking state control step of controlling a locking state of the first memory area on the basis of the initial use status of the expendable unit detected in said detection step and controlling a locking state of the second memory area on the basis of the use sate of the recording agent detected in said detection step.

16. The method according to claim 15, wherein data communication between the printing apparatus and the memory is made by wireless.

17. The method according to claim 15, wherein, when the amount of the recording agent in the expendable unit detected in said detection step reaches a predetermined amount or one of a plurality of predetermined amounts, data indicating that the amount of the recording agent has reached the predetermined amount is written in the second memory area of said memory in said write step, and, in said lock state control step, said memory is controlled so that the second memory area of the memory becomes locked.

18. An expendable unit which has a recording agent used in a print process and is detachable from a printing apparatus, comprising:

communication means for communicating with the printing apparatus in a condition that said expendable unit is attached to the printing apparatus;

a memory for storing and holding information that concerns the expendable unit and the recording agent, and writing and reading out data via said communication means when said expendable unit is attached to the printing apparatus, wherein said memory has a first memory area storing data concerning an initial use state of said expendable unit, a second memory area storing data concerning the recording agent in said expendable unit, and a setting area setting inhibition/permission of writing with respect to the first memory area and the second memory area.

19. The expendable unit according to claim 18, wherein said communication means is means for communicating with the printer via a serial communication line.

20. The expandable unit according to claim 18, wherein said communication means is means for communicating with the printer by wireless transmission.

21. The expendable unit according to claim 18, wherein the second memory area of said memory stores information concerning an amount of recording agent in the expendable unit, wherein, when the amount of the recording agent in the expendable unit is less than a predetermined amount or one of a plurality of predetermined amounts, writing to the second memory area of said memory is set to be inhibited.

22. The expendable unit according to claim 18, wherein said second memory area has address areas corresponding to a plurality of predetermined amounts of recording agent, when the amount of recording agent in the expendable unit reaches a predetermined amount, data indicating that the amount of recording agent reaches the predetermined amount is written to the second memory area corresponding to the predetermined amount, and writing to the written data area is set to be inhibited.

23. The apparatus according to claim 1, wherein said agent is toner and said expendable unit is a toner cartridge.

24. The apparatus according to claim 1, wherein the apparatus is an electrophotographic-type image forming apparatus.

25. The apparatus according to claim 6, wherein said agent is toner and said expendable unit is a toner cartridge.

26. The apparatus according to claim 6, wherein the apparatus is an electrophotographic-type image forming apparatus.

27. The expendable unit according to claim 18, wherein said agent is toner and said expendable unit is a toner cartridge.

28. The expendable unit according to claim 18, wherein the apparatus is an electrophotographic-type image forming apparatus.

29. A memory unit provided to an expendable unit which can be detachably attached to a printing apparatus, said memory unit comprising:

a first memory area to store data that concerns an initial use state of the expendable unit; and a second memory area to store data that concerns a use state of a recording agent of the expendable unit;

a third memory area to store data for determining inhibition/permission of writing with respect to said first memory area and the second memory area.

30. The memory unit according to claim 29, wherein said third memory area is a specific address area or a specific bit area of the memory unit.

31. The memory unit according to claim 29, wherein the data concerning the expendable unit is information related to a remaining amount of the expendable agent.

32. The memory unit according to claim 29, wherein the data concerning the expendable unit is information concerning whether or not the expendable unit is new.

33. The memory unit according to claim 29, wherein the data concerning the expendable unit is date information concerning when the expendable unit has been attached to the printing apparatus for the first time.

34. The apparatus according to claim 1, wherein data concerning the expendable unit is information whether or not the expendable unit is new.

35. The apparatus according to claim 6, wherein data concerning the expendable unit is information whether or not the expendable unit is new.

36. The expendable unit according to claim 18, wherein data concerning the expendable unit is information whether or not the expendable unit is new.

* * * * *

UNITED STATES PATENT AND TRADEMARK OFFICE

CERTIFICATE OF CORRECTION

PATENT NO. : 7,031,012 B1
APPLICATION NO. : 09/675147
DATED : April 18, 2006
INVENTOR(S) : Yoji Serizawa It is certified that error appears in the above-identified patent and that said Letters Patent is hereby corrected as shown below:

Column 8:
Line 56, “controll” should read --control--.

Column 12:
Line 2, “areas” should read --areas,--.
Line 42, “said a” should read --said--.
Line 44, “unit” should read --unit,--.

Column 13:
Line 55, “said a” should read --said--.
Line 56, “a initial” should read --an initial--.

Signed and Sealed this

Fifteenth Day of May, 2007

JON W. DUDAS
*Director of the United States Patent and Trademark Office*